US009903100B2

(12) United States Patent
Fletcher et al.

(10) Patent No.: US 9,903,100 B2
(45) Date of Patent: Feb. 27, 2018

(54) EXCAVATION SYSTEM PROVIDING AUTOMATED TOOL LINKAGE CALIBRATION

(71) Applicant: Caterpillar Inc., Peoria, IL (US)

(72) Inventors: Jeffrey Graham Fletcher, Peoria, IL (US); Daniel Aaron Jones, Tasmania (AU); Ricky Kam Ho Chow, Queensland (AU); Ranishka De Silva Hewavisenthi, Queensland (AU)

(73) Assignee: Caterpillar Inc., Peoria, IL (US)

( * ) Notice: Subject to any disclaimer, the term of this patent is extended or adjusted under 35 U.S.C. 154(b) by 140 days.

(21) Appl. No.: 14/790,088

(22) Filed: Jul. 2, 2015

(65) Prior Publication Data

US 2017/0002548 A1 Jan. 5, 2017

(51) Int. Cl.
*E02F 9/26* (2006.01)
*E02F 3/28* (2006.01)
*E02F 3/84* (2006.01)

(52) U.S. Cl.
CPC ..... *E02F 9/265* (2013.01); *E02F 3/28* (2013.01); *E02F 3/844* (2013.01)

(58) Field of Classification Search
CPC ..... E02F 3/28; E02F 3/844; E02F 9/265
See application file for complete search history.

(56) References Cited

U.S. PATENT DOCUMENTS 5,065,326 A 11/1991 Sahm
5,293,944 A 3/1994 Matsumoto
5,535,532 A 7/1996 Fujii et al.
5,617,724 A 4/1997 Ko
(Continued)

FOREIGN PATENT DOCUMENTS

CN 103292715 9/2013
WO WO 2010/074003 A1 7/2010

OTHER PUBLICATIONS

U.S. Patent Application entitled "Excavation System Providing Impact Detection" filed on Jul. 2, 2015 by Jeffrey Graham Fletcher et al.

(Continued)

*Primary Examiner* — Jerrah Edwards
*Assistant Examiner* — Kelly D Williams
(74) *Attorney, Agent, or Firm* — Finnegan, Henderson, Farabow, Garrett & Dunner, LLP

(57) ABSTRACT

An excavation system is disclosed as having first and second actuators configured to move a work tool in first and second directions. The second actuator may only be capable of full-range movement when the first actuator is positioned within a sub-range. The excavation system may also have first and second sensors configured to generate first and second signals indicative of first and second actuator movements, and a controller in communication with the first and second sensors. The controller may be configured to command movement of the first actuator to the sub-range, to confirm that the first actuator has moved to the sub-range based on the first signal, to command movement of the second actuator to an end-of-stroke position after the first actuator is confirmed to be within the sub-range, and to selectively record a current position of the second actuator as the end-of-stroke position based on the second signal.

19 Claims, 3 Drawing Sheets

(56) References Cited

U.S. PATENT DOCUMENTS

| | | | |
|---|---|---|---|
| 5,960,378 | A | 9/1999 | Watanabe et al. |
| 5,968,103 | A | 10/1999 | Rocke |
| 5,974,352 | A | 10/1999 | Shull |
| 6,205,687 | B1 | 3/2001 | Rocke |
| 6,321,153 | B1 | 11/2001 | Rocke et al. |
| 6,363,632 | B1 | 4/2002 | Stentz et al. |
| 6,615,114 | B1 | 9/2003 | Skiba et al. |
| 6,879,899 | B2 | 4/2005 | Budde |
| 7,555,855 | B2 | 7/2009 | Alshaer et al. |
| 7,640,683 | B2 | 1/2010 | McCain |
| 7,658,234 | B2 | 2/2010 | Brandt et al. |
| 7,797,934 | B2 | 9/2010 | Bacon et al. |
| 7,853,382 | B2 | 12/2010 | Anderson |
| 7,865,285 | B2 | 1/2011 | Price et al. |
| 8,042,290 | B2 | 10/2011 | Hartwick |
| 8,145,394 | B2 | 3/2012 | Chiorean et al. |
| 8,160,783 | B2 | 4/2012 | Shull |
| 8,280,596 | B2 | 10/2012 | Hagenbuch |
| 8,363,210 | B2 | 1/2013 | Montgomery |
| 8,478,492 | B2 | 7/2013 | Taylor et al. |
| 8,527,155 | B2 | 9/2013 | Gudat |
| 8,654,608 | B2 | 2/2014 | Lindskov |
| 8,726,647 | B2 | 5/2014 | Peterson et al. |
| 8,813,486 | B2 | 8/2014 | Peterson et al. |
| 8,838,329 | B2 | 9/2014 | Seki |
| 8,874,265 | B2 | 10/2014 | Rakshit |
| 8,886,493 | B2 | 11/2014 | Taylor |
| 8,903,689 | B2 | 12/2014 | Dunbabin et al. |
| 2011/0301781 | A1* | 12/2011 | Karlsson ..... E02F 9/26 701/1 |
| 2012/0055051 | A1 | 3/2012 | Polston et al. |
| 2013/0158789 | A1 | 6/2013 | Seki |
| 2014/0277957 | A1 | 9/2014 | Clar et al. |
| 2014/0326039 | A1* | 11/2014 | Ikegami ..... E02F 9/264 73/1.79 |
| 2016/0040398 | A1* | 2/2016 | Kitajima ..... E02F 3/435 701/50 |

OTHER PUBLICATIONS

U.S. Patent Application entitled "Excavation System Providing Automated Tool Linkage Calibration" filed on Jul. 2, 2015 by Jeffrey Graham Fletcher et al.

U.S. Patent Application entitled "Excavation System Providing Automated Stall Correction" filed on Jul. 2, 2015 by Jeffrey Graham Fletcher et al.

U.S. Application entitled "Excavation System Having Adaptive Dig Control" filed on Jul. 2, 2015 by Jeffrey Graham Fletcher et al.

U.S. Application entitled "Excavation System Having Velocity Based Work Tool Shake" filed on Jul. 2, 2015 by Jeffrey Graham Fletcher et al.

* cited by examiner

EXCAVATION SYSTEM PROVIDING AUTOMATED TOOL LINKAGE CALIBRATION

TECHNICAL FIELD

The present disclosure is directed to an excavation system and, more particularly, to an excavation system providing automated tool linkage calibration.

BACKGROUND

Heavy equipment, such as load-haul-dump machines (LHDs), wheel loaders, carry dozers, etc., are used during an excavation process to scoop up loose material from a pile at a first location (e.g., within a mine tunnel), to haul the material to a second location (e.g., to a crusher), and to dump the material. A productivity of the excavation process can be affected by an efficiency of each machine during every excavation cycle. In particular, the efficiency of each machine increases when the machine's tool (e.g., a bucket) is fully loaded with material at the pile within a short amount of time, hauled via a direct path to the second location, and quickly dumped.

The efficiency of a machine can be affected by accuracy in movements of the machine's tool linkage system. In particular, when a machine has full movement capacity, and the movements precisely correspond with operator and/or autonomous control commands, the machine may perform at a higher level. The movement capacity and precision may be ensured by periodic calibration of the tool linkage system.

An exemplary calibration system is disclosed in U.S. Pat. No. 6,615,114 of Skiba et al. that issued on Sep. 2, 2003 ("the '114 patent"). The calibration system includes a position sensor coupled to a lift cylinder of a front-end loader, and an electronic control module (ECM) operatively coupled to the position sensor. The position sensor senses the position of a piston inside the lift cylinder, and generates a corresponding position signal directed to the ECM. During a calibration process, the ECM generates and transmits a command signal to fully extend the lift cylinder. As the lift cylinder is extending, the movement of the piston is monitored by the position sensor. The ECM differentiates the signals generated by the position sensor during cylinder extension to detect when a velocity of the cylinder is zero. Once a signal representative of the cylinder being in a fully extended position is generated by the position sensor (i.e., when the cylinder velocity is zero), the ECM stores the value of the position signal in memory. The ECM then uses this value as a fully extended calibration factor. The ECM also performs a similar calibration process with respect to moving the lift cylinder to its fully retracted position.

Although the calibration system of the '114 patent may be helpful in calibrating a position sensor associated with a lift cylinder, it may lack applicability to more complicated machines, where multiple actuators interact with each other in a dependent manner.

The disclosed excavation system is directed to overcoming one or more of the problems set forth above and/or other problems of the prior art.

SUMMARY

One aspect of the present disclosure is directed to an excavation system for a machine having a work tool. The excavation system may include a first actuator configured to move the work tool in a first direction, and a second actuator configured to move the work tool in a second direction. The second actuator may only be capable of full range second actuator movement when the first actuator is positioned within a sub-range of first actuator movement. The excavation system may also include a first sensor configured to generate a first signal indicative of movement of the first actuator, a second sensor configured to generate a second signal indicative of movement of the second actuator, and a controller in communication with the first and second sensors. The controller may be configured to command movement of the first actuator to the sub-range, and to confirm that the first actuator has moved to the sub-range based on the first signal. The controller may also be configured to command movement of the second actuator to an end-of-stroke position after the first actuator is confirmed to be within the sub-range, and to selectively record a current position of the second actuator as the end-of-stroke position based on the second signal.

Another aspect of the present disclosure is directed to a method of controlling a machine having a work tool and first and second actuators connected to move the work tool in different directions. The method may include commanding movement of the first actuator to a sub-range of first actuator movements that allows full range movement of the second actuator, and sensing movement of the first actuator. The method may also include commanding movement of the second actuator to an end-of-stroke position after the first actuator is within the sub-range, and sensing movement of the second actuator. The method may further include selectively recording a current position of the second actuator as the end-of-stroke position.

Another aspect of the present disclosure is directed to a machine. The machine may include a frame, a work tool, lift arms pivotally connected at a first end to the frame and at a second end to the work tool, lift cylinders connected between the frame and the lift arms, and a tilt cylinder operatively connected between the frame and the lift arms. The tilt cylinder may only be capable of full range tilting movement when the lift cylinders are positioned within a sub-range of lifting movement. The machine may further include a lift sensor configured to generate a first signal indicative of movement of the lift cylinders, a tilt sensor configured to generate a second signal indicative of movement of the tilt cylinder, and a controller in communication with the lift and tilt sensors. The controller may be configured to command movement of the lift cylinders to a maximum lift position, to confirm that the lift cylinders have been moved to the maximum lift position when a change in the first signal indicates a lift speed less than a threshold value, and to responsively record the current lift position as the maximum lift position. The controller may also be configured to command movement of the lift cylinders to a minimum lift position, to confirm that the lift cylinders have been moved to the minimum lift position when the change in the first signal indicates the lift speed less than the threshold value, and to responsively record the current lift position as the minimum lift position. After recording the maximum and minimum lift positions, the controller may additionally be configured to command movement of the lift cylinders to the sub-range, to confirm that the lift cylinders have moved to the sub-range based on a position value of the first signal, to command movement of the tilt cylinder to an end-of-stroke position after the lift cylinders are confirmed to be within the sub-range, and to selectively record a current position of the tilt cylinder as the end-of-stroke position when a change in the second signal indicates a tilt speed less than a threshold value. The controller may be further configured to selectively create a position-to-sensor reading map based on recordation of the maximum lift position, the minimum lift position, and the end-of-stroke position.

DETAILED DESCRIPTION

Figure 1:
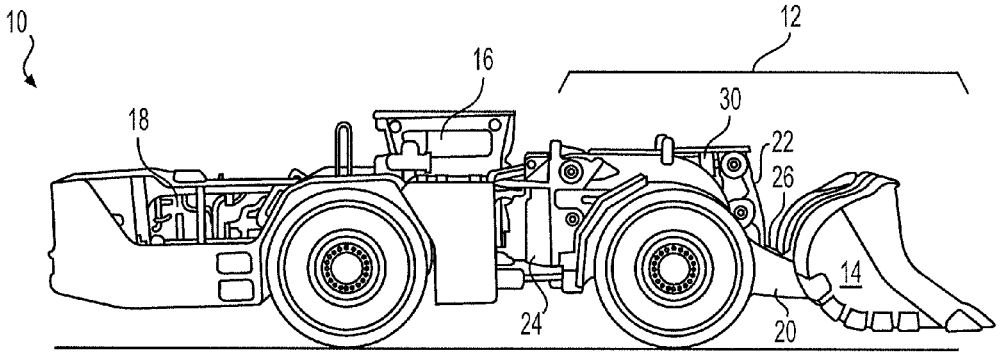
FIGS. 1 and 2 are side and top-view diagrammatic illustrations, respectively, of an exemplary disclosed machine operating at a worksite.
Figure 2:
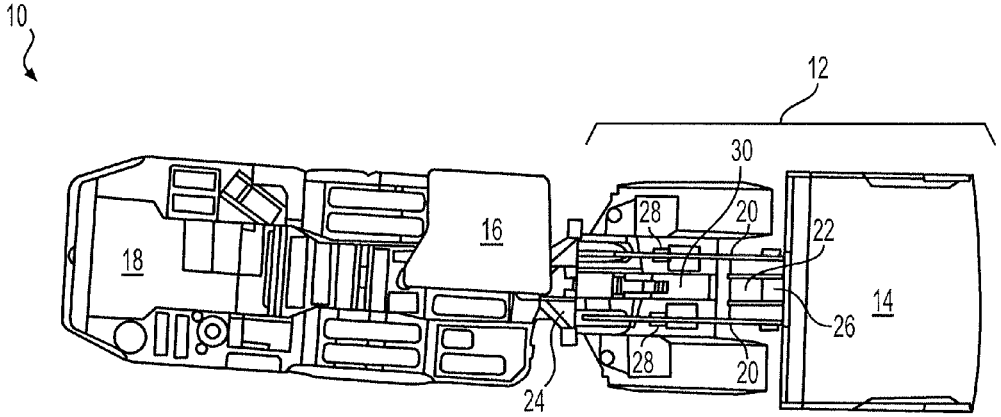

FIGS. 1 and 2 illustrate an exemplary machine 10 having multiple systems and components that cooperate to move material such as ore, overburden, waste, etc. In the disclosed example, machine 10 is a load-haul-dump machine (LHD). It is contemplated, however, that machine 10 could embody another type of excavation machine (e.g., a wheel loader or a carry dozer), if desired. Machine 10 may include, among other things, a linkage arrangement 12 configured to move a work tool 14, an operator station 16 for manual control of linkage arrangement 12, and a power source 18 (e.g., an engine) that provides electrical, hydraulic, and/or mechanical power to linkage arrangement 12 and operator station 16.

Linkage arrangement 12 may include fluid actuators that exert forces on structural components of machine 10 to cause lifting and tilting movements of work tool 14. Specifically, linkage arrangement 12 may include, among other things, a pair of spaced apart generally plate-like lift arms 20, and a bell crank 22 centered between and operatively connected to lift arms 20. Lift arms 20 may be pivotally connected at a proximal end to a frame 24 of machine 10 and at a distal end to work tool 14. Bell crank 22 may be pivotally connected to work tool 14 directly, or indirectly via a tilt link 26. A pair of substantially identical lift cylinders 28 (shown only in FIG. 2) may be pivotally connected at a first end to frame 24 and at an opposing second end to lift arms 20. A tilt cylinder 30 may be located between lift arms 20 and pivotally connected at a first end to frame 24 and at an opposing second end to bell crank 22. With this arrangement, extensions and retractions of lift cylinders 28 may function to raise and lower lift arms 20, respectively, along with connected work tool 14, bell crank 22, and tilt link 26. Similarly, extensions and retractions of tilt cylinder 30 may function to rack and dump work tool 14, respectively. This arrangement may be recognized as similar to a commonly known Z-bar linkage. It is contemplated, however, that machine 10 could have another linkage arrangement, if desired.

Numerous different work tools 14 may be attachable to a single machine 10 and controllable via operator station 16. Work tool 14 may include any device used to perform a particular task such as, for example, a bucket (shown in FIGS. 1 and 2), a fork arrangement, a blade, a shovel, a crusher, a shear, a grapple, a grapple bucket, a magnet, or any other task-performing device known in the art. Although connected in the embodiment of FIGS. 1 and 2 to lift and tilt relative to machine 10, work tool 14 may alternatively or additionally rotate, swing, slide, extend, open and close, or move in another manner known in the art.

Operator station 16 may be configured to receive input from a machine operator indicative of a desired work tool movement. Specifically, operator station 16 may include one or more input devices 32 (shown only in FIG. 3) embodied, for example, as single or multi-axis joysticks located proximal an operator seat (not shown). Input devices 32 may be proportional-type controllers configured to position and/or orient work tool 14 by producing a work tool position signal that is indicative of a desired work tool speed and/or force in a particular direction. The position signal may be used to actuate any one or more of lift and tilt cylinders 28, 30. It is contemplated that different input devices may additionally or alternatively be included within operator station 16 such as, for example, wheels, knobs, push-pull devices, switches, pedals, and other operator input devices known in the art. It is contemplated that operator station 16 could be omitted in applications where machine 10 is remotely or autonomously controlled, if desired.

Power source 18 may be supported by frame 24 of machine 10, and configured to generate the electrical, hydraulic, and/or mechanical power discussed above. In the disclosed embodiment, power source 18 is an engine, for example a diesel engine, that combusts a mixture of fuel and air to produce the power. In other embodiments, however, power source 18 could include a fuel cell, a battery, a tethered motor, or another source known in the art.

Lift and tilt cylinders 28, 30 may each be a linear type of actuator consisting of a tube and a piston assembly arranged within the tube to form opposing control chambers. The control chambers may each be selectively supplied with pressurized fluid and drained of the pressurized fluid to cause the piston assembly to displace within the tube, thereby changing an effective length of lift and tilt cylinders 28, 30 and moving work tool 14. A flow rate of fluid into and out of the control chambers may relate to a translational speed of the cylinders, while a pressure differential between the control chambers may relate to a force imparted by the cylinders on the associated structure of linkage arrangement 12. It is contemplated that lift and/or tilt cylinders 28, 30 could be replaced with another type of actuator (e.g., a rotary actuator), if desired.

Figure 3:
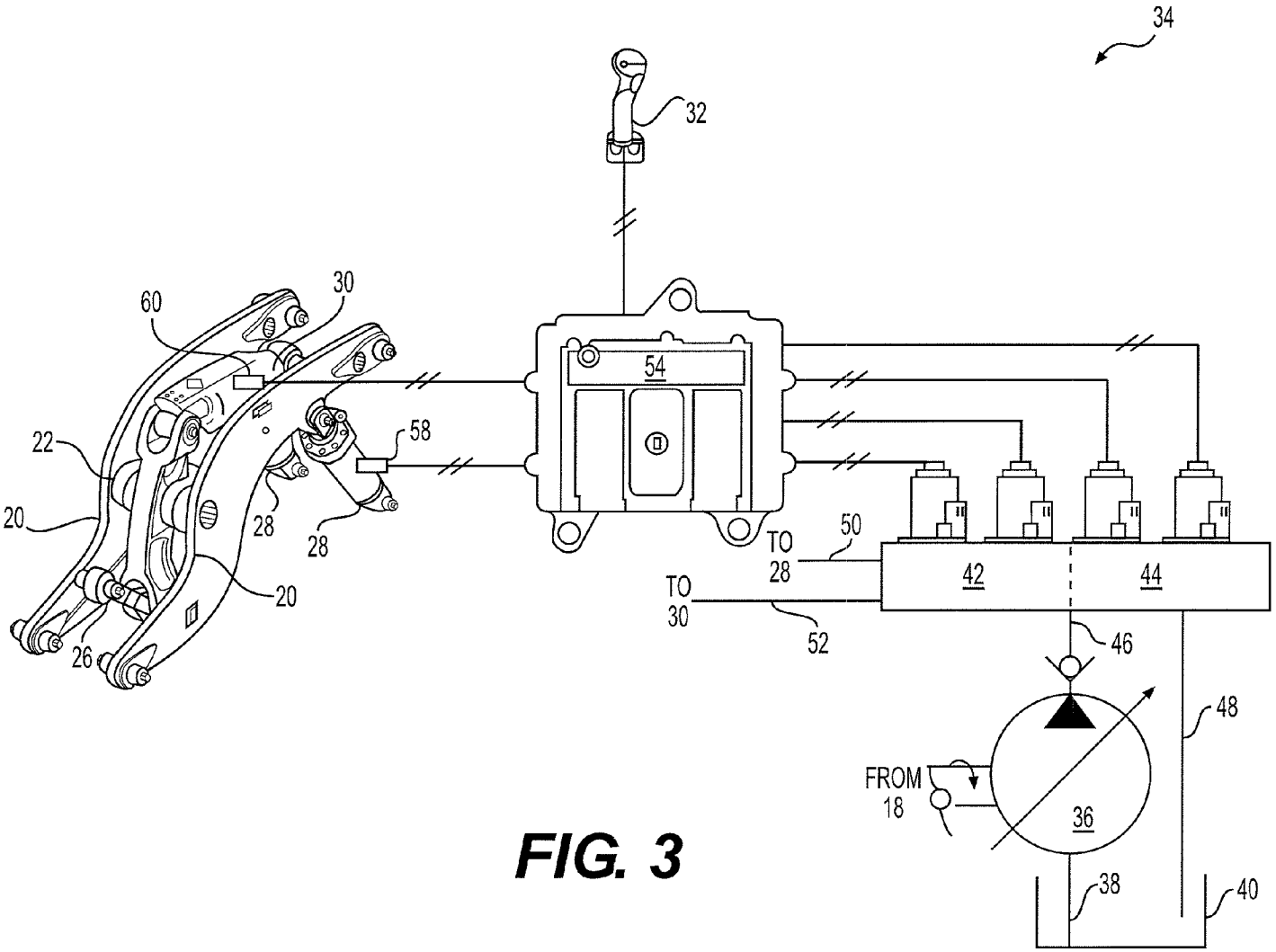
FIG. 3 is a diagrammatic illustration of an exemplary disclosed excavation system that may be used in conjunction with the machine of FIGS. 1 and 2.

As illustrated in FIG. 3, lift and tilt cylinders 28, 30 and input device 32 may form portions of an excavation system ("system") 34. System 34 may include one or more fluid circuits that distribute pressurized oil used to drive the cylinders described above in response to received input. In particular, system 34 may include, among other things, a common pump 36 connected via a suction passage 38 to a common low-pressure reservoir 40, and one or more control valves (e.g., one or more lift control valves 42 and one or more tilt control valves 44). Pump 36 may be configured to draw fluid from reservoir 40 via suction passage 38 and to pressurize the fluid. Valves 42, 44 may be connected to pump 36 via a supply passage 46 to receive the pressurized fluid, and also to reservoir 40 via a drain passage 48. In addition, valves 42, 44 may be connected to the corresponding lift cylinders 28 and tilt cylinder 30 via one or more conduits 50 and 52, respectively. Each control valve 42, 44 may be responsible for connecting supply passage 46 and drain passage 48 to particular control chambers inside the corresponding actuators to cause commanded extensions or retractions of the actuators between opposing end-of-stroke (i.e., maximum and minimum) displacement positions.

In manually controlled applications, the commands to extend or retract lift and tilt cylinders 28, 30 may be generated via input device 32 and processed by an on-board controller 54. That is, on-board controller 54 may receive the input from the operator via device 32, and convert the input into commands directed to valves 42, 44. In remotely or autonomously controlled applications, however, the commands may be directly generated by on-board controller 54 or by another off-board controller (not shown) that is in remote communication with on-board controller 54. Regardless of the application, controller 54 may additionally be configured to monitor the movements of lift and tilt cylinders 28, 30 achieved as a result of the commands. In particular, excavation system 34 may include one or more sensors (e.g., a lift sensor 58 and a tilt sensor 60) configured to provide feedback to controller 54 regarding commanded movements.

Controller 54 may embody a single microprocessor or multiple microprocessors that include a means for monitoring operations of machine 10. For example, controller 54 may include a memory, a secondary storage device, a clock, and a processor, such as a central processing unit or any other means for accomplishing a task consistent with the present disclosure. Numerous commercially available microprocessors can be configured to perform the functions of controller 54. It should be appreciated that controller 54 could readily embody a general machine controller capable of controlling numerous other machine functions. Various other known circuits may be associated with controller 54, including signal-conditioning circuitry, communication circuitry, and other appropriate circuitry.

Sensors 58 and 60 may each embody an extension sensor located internally or externally of cylinders 28, 30; a rotational position sensor associated with the pivoting motions of linkage arrangement 12; a local or global coordinate position sensor associated with work tool 14; or any other type of sensor known in the art that generates a signal indicative of extending or retracting movements of cylinders 28, 30. Signals generated by these sensors 58, 60 may be sent to controller 54 for further processing. It is contemplated that controller 54 may derive any number of different parameters based on the signals from sensors 58, 60 and, for example, an elapsed period of time (e.g., a time period tracked by an internal or external timer—not shown). In particular, controller 54 could determine position values, orientation values, speed values, acceleration values, etc. Controller 54 may then use this information to confirm a status of a commanded movement. That is, based on the signals generated by sensors 58, 60, controller 54 may determine if a desired speed is being achieved, if a desired position or orientation has been attained, etc. And from this feedback, controller 54 may selectively adjust the commands directed to valves 40, 42.

Figure 4:
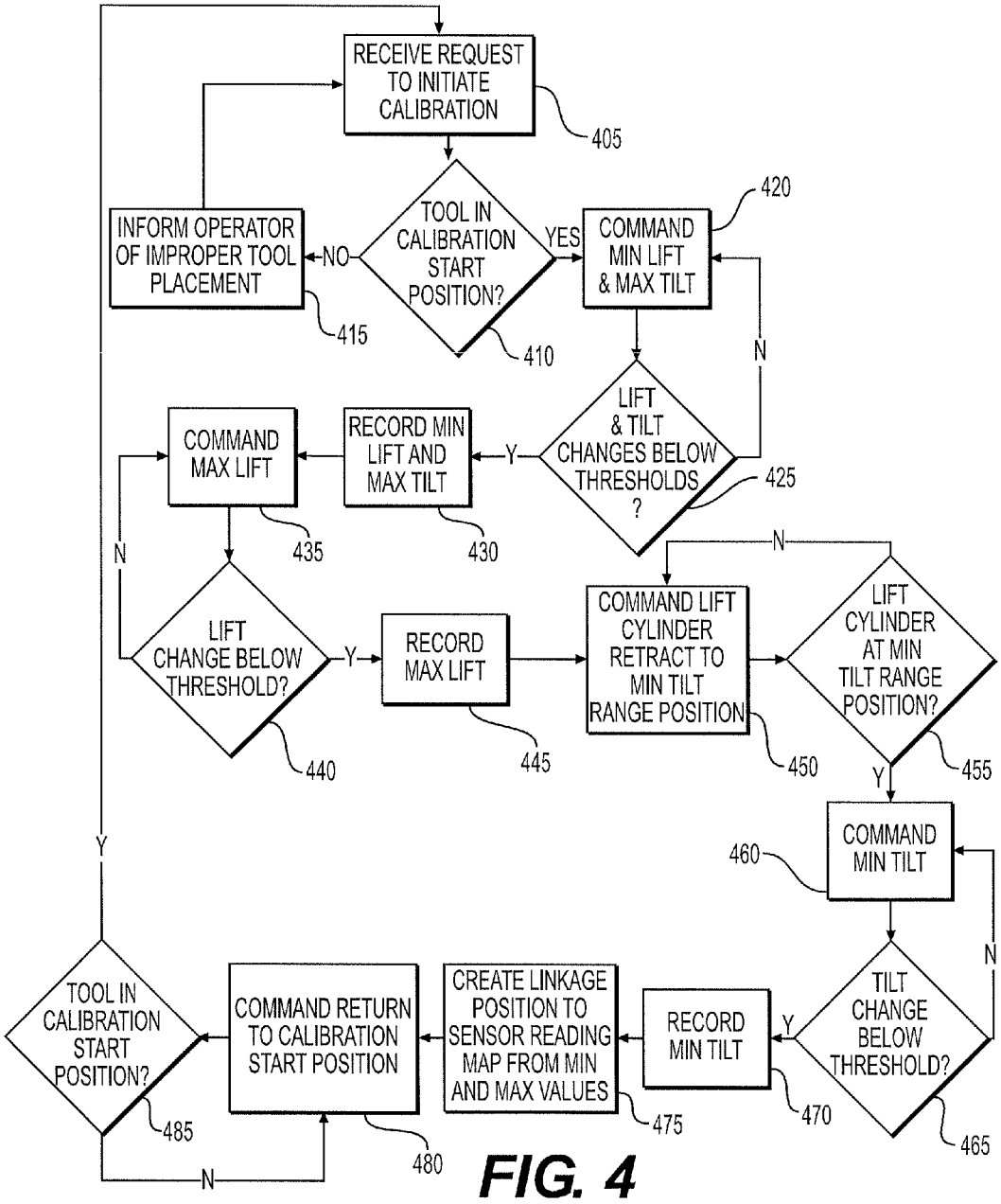
FIG. 4 is a flowchart depicting an exemplary disclosed method that may be performed by the excavation system of FIG. 3.

In order for controller 54 to make the necessary command adjustments described above, the information received from sensors 58, 60 should be accurate. As shown in FIG. 4, controller 54 may be configured to selectively implement a calibration process involving sensors 58, 60 to help ensure the accuracy of sensors 58, 60. FIG. 4 will be discussed in more detail in the following section to further illustrate the disclosed concepts.

INDUSTRIAL APPLICABILITY

The disclosed excavation system finds potential application within any machine at any worksite where it is desirable to provide tool loading assistance and/or automated control. The excavation system finds particular application within an LHD, wheel loader, or carry dozer that has multiple actuators, which interact to cooperatively move a work tool. The excavation system may help to ensure precise and efficient work tool movements through the use of a unique sensor calibration process. Operation of excavation system 34 will now be described in detail with reference to FIG. 4.

Controller 54 may be triggered to initiate the calibration process in many different ways. In one example, controller 54 may receive a request for calibration initiation (Step 405). This request may be received manually from a local or remote operator (e.g., via input device 32). In another example, controller 54 may determine a need to recalibrate sensors 58, 60, such as when work tool 14 does not reach an expected position or does not move with an expected speed or acceleration. In yet another example, controller 54 may initiate the calibration process based on a time elapsed since a previous calibration event. Other ways to initiate the calibration process may also be implemented.

After the request for calibration initiation is received, controller 54 may check to see if conditions are appropriate for start of the process. For example, controller 54 may check to see if work tool 14 is within a pre-defined calibration range of positions (Step 410). This pre-defined calibration range of positions may correspond with linkage arrangement 12 being in a low-energy state. In one specific example, the low-energy state may correspond with lift arms 20 being lowered below a particular elevation and/or with a bottom surface of work tool 14 resting generally parallel to (e.g., on) a ground surface. It is contemplated that the operator may perform this function and then indicate to controller 54 that work tool 14 is in the correct position. Alternatively, the operator may perform this function while controller 54 monitors and confirms that work tool 14 is in the calibration start position (Step 415). If controller 54 is programmed to monitor and confirm the calibration start position of work tool 14, controller 54 may selectively inform the operator when work tool 14 is in an improper position (Step 415). Control may cycle through steps 405-415 until work tool 14 has moved to within the range of acceptable start positions.

Once work tool 14 is within the range of acceptable start positions, controller 54 may assume calibration control and command work tool movement to a minimum lift position (i.e., to a full lower position) and to a maximum tilt position (i.e., to a full rack position) (Step 420). These movements may be commanded and achieved sequentially or simultaneously, as desired. During the movements, controller 54 may monitor the speeds of lift and tilt cylinders 28, 30 (e.g., sensors 58, 60) to determine when the corresponding changes in piston assembly displacements fall below a threshold value for a given period of time (Step 425). This threshold value for both lift and tilt may be about 0.3 m/s, and corresponds with lift and tilt cylinders 28, 30 reaching their end-of-stroke positions. It is contemplated that, in some embodiments, the lift and tilt speed thresholds may be different, if desired. Controller 54 may continue commanding minimum lift and maximum tilt positions until step 425 is satisfied (i.e., control may cycle through steps 420 and 425 until both of the corresponding end-of-stroke positions are attained). Thereafter, controller 54 may record the corresponding current positions in memory as the minimum lift and maximum tilt positions (Step 430).

After calibration of the minimum lift and maximum tilt positions, controller 54 may command work tool 14 to move to its maximum lift position (Step 435), while monitoring the movement. Controller 54 may compare the displacement speed of lift cylinders 28 to a threshold value (Step 440). This threshold value for lift may again be about 0.3 m/s, and corresponds with lift cylinders 28 reaching their end-of-stroke positions. It is contemplated that, in some embodiments, the maximum and minimum lift speed thresholds may be different, if desired. Controller 54 may continue commanding maximum lift position until step 435 is satisfied (i.e., control may cycle through steps 435 and 440 until the corresponding end-of-stroke position is attained). Thereafter, controller 54 may record the corresponding current position in memory as the maximum lift position (Step 445).

The linkage configuration of machine 10 may allow for work tool 14 to be tilted to its minimum position only when work tool 14 is lifted to within a particular sub-range of its entire lift range. For example, work tool 14 may only be tilted to its maximum position when it has been lifted to about 55-65% (e.g., to about 60%) of the distance from its minimum lift position to its maximum lift position. Accordingly, after calibration of the maximum lift position, controller 54 may command work tool 14 to move to the particular sub-range described above that corresponds with the minimum tilt capability (Step 450).

During the lifting movement of work tool 14 to the minimum tilt sub-range, controller 54 may not be able to rely on monitored speed to determine that work tool 14 has reached the sub-range, as lift cylinders 28 would not reach an end-stop that causes the speed to fall below a threshold. Instead, since controller 54 has already calibrated the minimum and maximum lift positions, controller 54 can now accurately monitor just the displacement positions (regardless of speed) of lift cylinders 28 to determine when work tool 14 has reached the sub-range (Step 455). Control may cycle through steps 450 and 455 until the sub-range has been reached.

After work tool 14 has been lifted to the minimum tilt sub-range, controller 54 may command work tool 14 to move to its minimum tilt position (Step 460), while monitoring the movement. Controller 54 may compare the displacement speed of tilt cylinder 30 to a threshold value (Step 465). This threshold value for tilt may again be about 0.3 m/s, and corresponds with tilt cylinder 30 reaching its end-of-stroke position. It is contemplated that, in some embodiments, the maximum and minimum tilt speed thresholds may be different, if desired. Controller 54 may continue commanding minimum tilt position until step 465 is satisfied (i.e., control may cycle through steps 460 and 465 until the corresponding end-of-stroke position is attained). Thereafter, controller 54 may record the corresponding current position in memory as the minimum tilt position (Step 470).

After the maximum and minimum lift and tilt positions have been recorded into the memory of controller 54, controller 54 may create a linkage position-to-sensor reading map from the position values (Step 475). This map may then be used to generate future work tool movement commands. Controller 54 may then command return of work tool 14 to the original calibration start position (Step 480), while monitoring the movement. When controller 54 determines that work tool 14 is in the original calibration start position (Step 485: Y), control may return to step 405.

This disclosed excavation system may provide for enhanced machine movement accuracy and efficiency by way of a unique calibration process. The calibration process may be enhance machine movement accuracy and efficiency by calibrating multiple interacting actuators in a manner that allows full movement of individual actuators during the calibration process, even when the movement of some of the actuators depend on prior calibration and movements of other actuators.

It will be apparent to those skilled in the art that various modifications and variations can be made to the excavation system of the present disclosure. Other embodiments will be apparent to those skilled in the art from consideration of the specification and practice of the excavation system disclosed herein. It is intended that the specification and examples be considered as exemplary only, with a true scope being indicated by the following claims and their equivalents.

What is claimed is:

1. An excavation system for a machine having a work tool, comprising:

a first actuator configured to move the work tool in a first direction;

a second actuator configured to move the work tool in a second direction, wherein the second actuator is only capable of full range second actuator movement when the first actuator is positioned within a sub-range of first actuator movement;

a first sensor configured to generate a first signal indicative of movement of the first actuator;

a second sensor configured to generate a second signal indicative of movement of the second actuator; and a controller in communication with the first and second sensors, the controller being configured to:

command movement of the first actuator to the sub-range;

confirm that the first actuator has moved to the sub-range based on a position value of the first signal;

command movement of the second actuator to an end-of-stroke position after the first actuator is confirmed to be within the sub-range; and selectively record a current position of the second actuator as the end-of-stroke position when a value change of the second signal indicates a second actuator speed less than a threshold value; and wherein the first actuator is a lift cylinder and the second actuator is a tilt cylinder, and;

wherein the sub-range is 55-65% of a distance from a minimum lift position to a maximum lift position.

2. The excavation system of claim 1, wherein the threshold value is 0.3 m/s.

3. The excavation system of claim 1, wherein the end-of-stroke position selectively recorded by the controller is a minimum tilt position.

4. The excavation system of claim 3, wherein the controller is further configured to command movement of the lift cylinder to a maximum lift position and to a minimum lift position, and to record corresponding sensed positions as the maximum and minimum lift positions, respectively, before commanding the lift cylinder to move to the sub-range.

5. The excavation system of claim 3, wherein the controller is further configured to:

command movement of the tilt cylinder to a maximum tilt position; and selectively record a current position of the tilt cylinder as the maximum tilt position when the second signal indicates a tilt cylinder speed less than a threshold speed.

6. The excavation system of claim 1, wherein the controller is further configured to:

receive a request for calibration; and selectively implement a calibration process based on the request only when at least one of the first and second actuators has moved to a calibration start position.

7. The excavation system of claim 6, wherein the controller is configured to selectively inform an operator of the machine that the at least one of the first and second actuators is not in the calibration start position.

8. The excavation system of claim 6, wherein the controller is configured to return the at least one of the first and second actuators to the respective calibration start position at completion of the calibration process.

9. The excavation system of claim 1, wherein the controller is further configured to selectively create a position-to-sensor reading map based on recordation of the current position of the second actuator as the end-of-stroke position.

10. A method of controlling a machine having a work tool and first and second actuators connected to move the work tool in different directions, the method comprising:

commanding movement of the first actuator to a sub-range of first actuator movements that allows full range movement of the second actuator;

sensing movement of the first actuator;

confirming that the first actuator has moved to the sub-range based on a position of the first actuator;

commanding movement of the second actuator to an end-of-stroke position after the first actuator is within the sub-range;

sensing movement of the second actuator;

selectively recording a current position of the second actuator as the end-of-stroke position only when a speed of the second actuator is less than a threshold value; and wherein the first actuator is a lift cylinder, the second actuator is a tilt cylinder; and the sub-range is 55-65% of a distance from a minimum lift position to a maximum lift position.

11. The method of claim 10, wherein the end-of-stroke position is a minimum tilt position.

12. The method of claim 11, further including:

commanding movement of the lift cylinder to a maximum lift position and to a minimum lift position; and recording corresponding sensed positions as the maximum and minimum lift positions, respectively, before commanding the lift cylinder to move to the sub-range.

13. The method of claim 12, further including:

commanding movement of the tilt cylinder to a maximum tilt position; and selectively recording a current position of the tilt cylinder as the maximum tilt position when a tilt cylinder speed is less than a threshold speed.

14. The method of claim 10, further including:

receiving a request for calibration;

selectively implementing a calibration process based on the request only when at least one of the first and second actuators has moved to a calibration start position;

selectively informing an operator of the machine that the at least one of the first and second actuators is not in the calibration start position; and returning the at least one of the first and second actuators to the calibration start position at completion of the calibration process.

15. A machine, comprising:

a frame;

a work tool;

lift arms pivotally connected at a first end to the frame and at a second end to the work tool;

lift cylinders connected between the frame and the lift arms;

a tilt cylinder operatively connected between the frame and the lift arms, wherein the tilt cylinder is only capable of full range tilting movement when the lift cylinders are positioned within a sub-range of lifting movement;

a lift sensor configured to generate a first signal indicative of movement of the lift cylinders;

a tilt sensor configured to generate a second signal indicative of movement of the tilt cylinder; and a controller in communication with the lift and tilt sensors, the controller being configured to:

command movement of the lift cylinders to a maximum lift position;

confirm that the lift cylinders have been moved to the maximum lift position when a change in the first signal indicates a lift speed less than a threshold value, and responsively record the current lift position as the maximum lift position;

command movement of the lift cylinders to a minimum lift position;

confirm that the lift cylinders have been moved to the minimum lift position when the change in the first signal indicates the lift speed less than the threshold value, and responsively record the current lift position as the minimum lift position;

after recording the maximum and minimum lift positions, command movement of the lift cylinders to the sub-range;

confirm that the lift cylinders have moved to the sub-range based on a position value of the first signal;

command movement of the tilt cylinder to an end-of-stroke position after the lift cylinders are confirmed to be within the sub-range;

selectively record a current position of the tilt cylinder as the end-of-stroke position when a change in the second signal indicates a tilt speed less than a threshold value; and selectively create a position-to-sensor reading map based on recordation of the maximum lift position, the minimum lift position, and the end-of-stroke position; and wherein the sub-range is 55-65% of a distance from the minimum lift position to the maximum lift position.

16. The machine of claim 15, wherein the threshold value is 0.3 m/s.

17. The machine of claim 15, wherein the controller is further configured to:

receive a request for calibration; and selectively implement a calibration process based on the request only when at least one of the lift cylinders and the tilt cylinder has moved to a calibration start position.

18. The machine of claim 17, wherein the controller is configured to selectively inform an operator of the machine that the at least one of the lift cylinders and the tilt cylinder is not in the calibration start position.

19. The machine of claim 17, wherein the controller is configured to return the at least one of the lift cylinders and the tilt cylinder to the respective calibration start position at completion of the calibration process.

* * * * *